US005851011A

United States Patent [19]

Lott

[11] Patent Number: 5,851,011

[45] Date of Patent: Dec. 22, 1998

[54] MULTI-DECK POKER PROGRESSIVE WAGERING SYSTEM WITH MULTIPLE WINNERS AND INCLUDING JACKPOT, BUST, AND INSURANCE OPTIONS

[76] Inventor: A. W. Lott, 12120 E. 24th St., Tulsa, Okla. 74129

[21] Appl. No.: 962,307

[22] Filed: Oct. 31, 1997

[51] Int. Cl.[6] ..... A63F 1/00

[52] U.S. Cl. ..... 273/292; 463/13; 463/27

[58] Field of Search ..... 276/292, 279, 276/309; 463/13, 12, 26, 27

[56] References Cited

U.S. PATENT DOCUMENTS

| | | | |
|---|---|---|---|
| 5,042,818 | 8/1991 | Weingardt | 273/292 |
| 5,366,228 | 11/1994 | Kangsanaraks | 273/292 |
| 5,377,973 | 1/1995 | Jones et al. | 273/292 |
| 5,377,994 | 1/1995 | Jones | 273/309 |
| 5,382,025 | 1/1995 | Sklansky et al. | 273/292 |
| 5,417,430 | 5/1995 | Breeding | 273/292 |
| 5,597,162 | 1/1997 | Franklin | 273/292 |
| 5,630,586 | 5/1997 | Lowden | 273/138.2 |
| 5,632,489 | 5/1997 | Rozzi, Sr. et al. | 273/304 |
| 5,639,092 | 6/1997 | Macaisa | 273/292 |
| 5,645,281 | 7/1997 | Hesse et al. | 273/292 |
| 5,657,993 | 8/1997 | Merlino et al. | 273/292 |
| 5,664,781 | 9/1997 | Feola | 273/292 |
| 5,775,992 | 7/1998 | Wood et al. | 463/13 |

OTHER PUBLICATIONS

Morehead & Mott–Smith Holye's Rules of Games, 1963, pp. 75–101, 174–177.

Graham & Tulcea A Book on Casino Gambling, 1978, pp. 56–77.

Computer Patent Search Conducted Oct. 8–9, 1997.

*Primary Examiner*—Benjamin H. Layno

*Attorney, Agent, or Firm*—Fellers, Snider, Blankenship, Bailey & Tippens, P.C.

[57] ABSTRACT

The present invention relates generally to a casino-type method of playing poker and to computer implementations thereof, wherein one or more players play a single hand against the house. It relates more particularly to a multi-deck method of playing a poker-like game wherein multiple players progressively wager on a single five-card player hand which is matched against a later-dealt best-five-of-seven card dealer hand, the winning hand being determined by traditional rules of poker. The instant invention allows multiple players to win based on the card combinations in the single player hand. It also provides for the possibility of a bust hand and for the purchase of insurance to protect against same. Finally, the instant invention is suitable for use with one or more progressive jackpots which a player may become eligible to win by paying a premium.

25 Claims, 4 Drawing Sheets

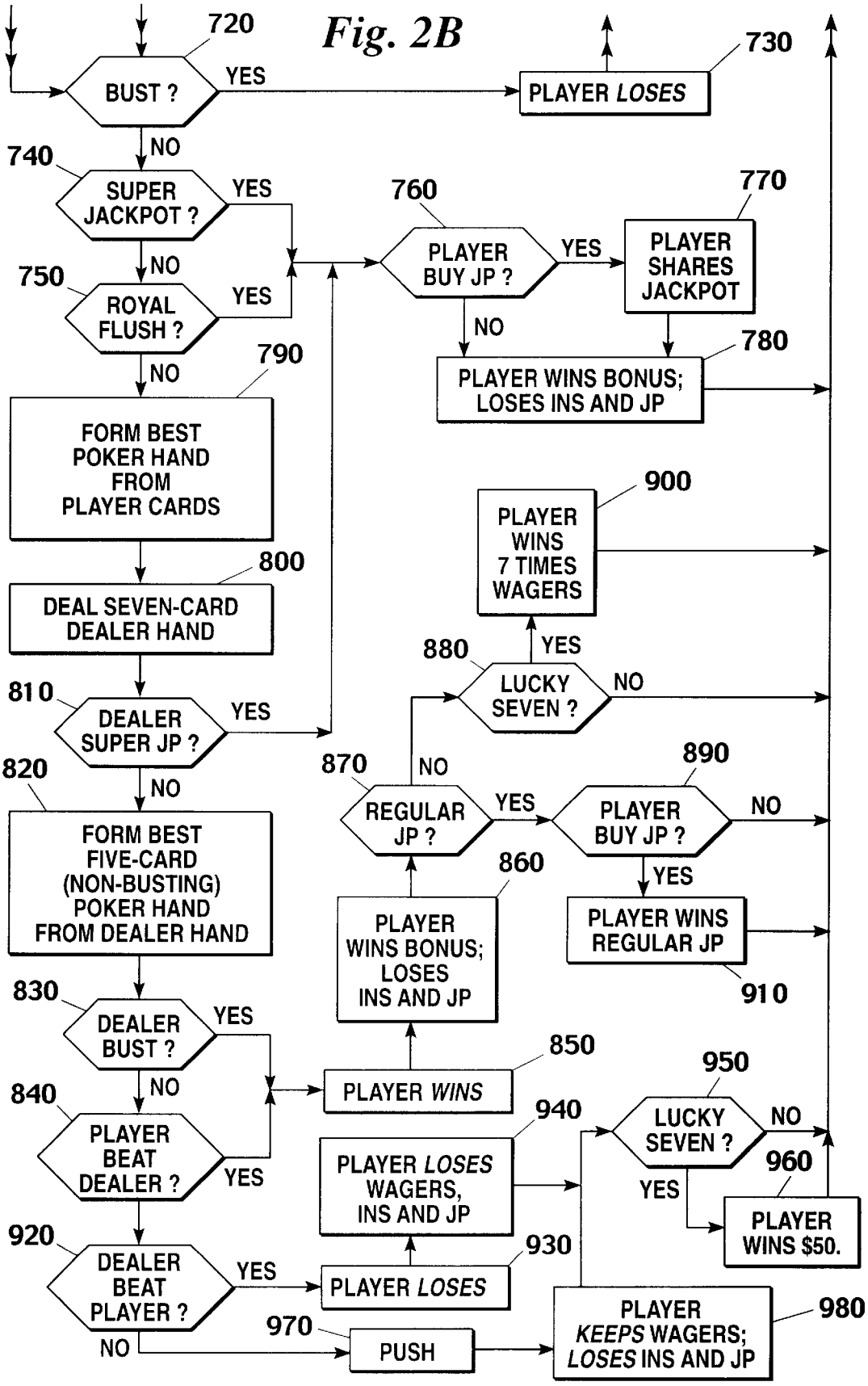
Fig. 2B
720
BUST ?
YES
PLAYER LOSES
730
NO
740
SUPER JACKPOT ?
YES
760
PLAYER BUY JP ?
YES
770
PLAYER SHARES JACKPOT
NO
750
ROYAL FLUSH ?
YES
NO
780
PLAYER WINS BONUS; LOSES INS AND JP
NO
790
FORM BEST POKER HAND FROM PLAYER CARDS
900
PLAYER WINS 7 TIMES WAGERS
800
DEAL SEVEN-CARD DEALER HAND
YES
880
LUCKY SEVEN ?
NO
810
DEALER SUPER JP ?
YES
870
NO
890
REGULAR JP ?
YES
PLAYER BUY JP ?
NO
820
NO
FORM BEST FIVE-CARD (NON-BUSTING) POKER HAND FROM DEALER HAND
860
PLAYER WINS BONUS; LOSES INS AND JP
YES
PLAYER WINS REGULAR JP
910
830
DEALER BUST ?
YES
850
PLAYER WINS
950
NO
840
PLAYER BEAT DEALER ?
YES
940
PLAYER LOSES WAGERS, INS AND JP
LUCKY SEVEN ?
NO
960
YES
PLAYER WINS $50.
920
DEALER BEAT PLAYER ?
YES
930
PLAYER LOSES
980
PLAYER KEEPS WAGERS; LOSES INS AND JP
970
NO
PUSH

MULTI-DECK POKER PROGRESSIVE WAGERING SYSTEM WITH MULTIPLE WINNERS AND INCLUDING JACKPOT, BUST, AND INSURANCE OPTIONS

FIELD OF THE INVENTION

The present invention relates generally to a casino-type method of playing poker and to automated computer implementations thereof. It relates more particularly to a multi-deck method of playing a poker variation wherein multiple players progressively wager on a single five-card player hand which is matched against a later-dealt best-five-of-seven card dealer hand, the winning hand being determined by the traditional rules of poker.

BACKGROUND

There are a multitude of card games that are based on one or more decks of conventional playing cards. Among the most popular of these games is poker, wherein a player's fortunes are determined by a well-known hierarchy of card combinations. As a corollary to the foregoing, card games that are variants of poker are also very popular. This is due, at least in part, to the basic nature of the underlying game itself, combining, as it does, elements of both strategy and luck. Additionally, poker-variants allow an existing player-base to capitalize on their preexisting knowledge of a game, and to apply that knowledge in other, novel, settings. Arguably the two most popular forms of traditional poker are draw poker and stud poker.

In a conventional hand of draw poker, a single 52-card deck of shuffled playing cards is used. Each player begins a hand by contributing an initial or "ante" bet to a common pool or "pot", the pot ultimately going to the owner of the winning hand. The dealer then distributes five face-down cards to each player, the remaining cards in the deck being set aside for later use. Each player evaluates the cards that he or she has been dealt and each, in turn, is given an opportunity to discard one or more cards from the dealt hand. The dealer gives the player replacement cards for those that have been discarded by dealing additional cards face-down from the top of the deck. Following the deal, one or more rounds of betting take place, during which time each player may check, fold (drop-out), or match or raise a previous bet. The meanings of these wagering terms are well know to those skilled in the art and typical definitions of same may be found in, for example, *Hoyle's Rules of Games*, pp. 75–102, by Morehead and Mot-Smith, 1963, the disclosure of which is incorporated herein by reference. At the conclusion of the wagering rounds, the players display their hands and the holder of the highest ranking poker hand takes all of the money in the pot.

Stud poker is the most popular form of "open poker," wherein each player is dealt some cards that are face-up and, hence, available for viewing by the other players. Stud poker comes in two varieties: 5-card and 7-card, the two being of approximately equal popularity. In five-card stud poker, the dealer gives each player a face-down (or "hole" card) and then a face-up card. Thus, at the start each player knows his own two cards and one card of each of his opponents. After the first two cards are dealt, a wagering round ensues, during which time each player contributes his or her wager to the pot. A typical description of the rules that govern this round might be found in, for example, *Hoyle's Rules of Games*, pp. 75–102, by Morehead and Mot-Smith, 1963, the disclosure of which is incorporated herein by reference. After the wagering round, another card is dealt face-up to each player.

This is followed by another wagering round. Alternating dealing and wagering rounds continue until each player has a total of five cards: four face-up and a concealed hole card. After the final bets have been placed, each player who has not dropped out during the deal/wager rounds reveals his or her hole card. The owner of the highest ranking 5-card poker hand wins and takes whatever amount is in the pot.

Seven-card stud poker differs slightly from 5-card poker. First, in 7-card poker each player initially receives two cards face-down and one card face-up. A bidding round then ensues. The dealer then gives each player another face-up card, which is followed again by a bidding round. Deals (of one face-up card) and bids are alternated until each player has four face-up cards and two face-down cards. Finally, a third face-down card is dealt to each player (making a total of seven cards). This is followed by a last bidding round. The winner of the hand is the player who can form the highest ranking 5-card poker hand from his seven cards.

As is well known to those skilled in the art, five-card poker hands are ranked from "Royal Flush" (highest) to "High Card(s) in Hand" (lowest) according to the following ordering:

| Hand | Description | Example |
|---|---|---|
| Royal Flush | The five top cards of a suit | A, K, Q, J, 10 (suited) |
| Straight Flush | Five cards in sequence in the same suit | 5, 6, 7, 8, 9 (suited) |
| Four of a Kind | Any four cards of the same rank | 7, 7, 7, 7, A |
| Full House | Three of a kind and a pair | 5, 5, 5, Q, Q |
| Flush | Five cards of the same suit | 5, 8, J, Q, A (suited) |
| Straight | Five cards in sequence | 6, 7, 8, 9, 10 (unsuited) |
| Three of a Kind | Three cards of the same rank | 5, 5, 5, Q, K |
| Two Pair | Two cards of the same rank and two others of a different rank | 9, 9, 3, J, A (unsuited) |
| High Card(s) in Hand | Five unmatched cards, one with a highest rank of the five | A, 9, 5, 3, 2 (unsuited) |

In some variations of poker, the ace may also act as the lowest card in the deck to form a straight when used in a sequence like A, 2, 3, 4. Additionally, a "wild card"—often the "joker" card may be designated, so that a person who holds that card may declare its value to be that of any card in the deck, the presumption being that the declared card value will help that player form a better poker hand.

At its core, poker is a vehicle for gambling. Commonly the quantities wagered are monetary, but that is not strictly required and poker chips, matches, and other non-pecuniary tokens have been used in place of money to help the players determine who is winning without exposing them to financial loss. Of course, casinos are in the business of providing people with the opportunity to gamble and, given the popularity of poker among the general populous, it only stands to reason that casinos would desire to offer this game in some form or another to those who seek to play it. However, conventional-rules poker is not particularly well suited for use in a casino.

A casino that offers traditional poker to its clientele typically does so by providing a dealer and a room in which to play, but the casino's dealer does not actually participate in the game as a player: his or her function is just to distribute the cards and referee the game. The casino makes its money by taking some percent of all of the money wagered (the "rake") or by leasing the room to the participants. The cost of the lease may be measured in time (e.g., a fixed amount per hour) or by a count of the number of hands played. Traditional poker games are not particularly favored by casinos because the casino does not make as much money acting as a landlord as it would if it were an active participant in the game.

Similarly, from the standpoint of the gaining public, traditional poker has some disadvantages which have tended to make it less desirable as a casino game. First, traditional poker is readily available "at home," e.g., at the Friday night poker session, and there is no particular need for most people to travel to a casino to play it. Second, when an individual wins at traditional poker it is at the expense of the other players/participants. Many people prefer to play against the "house" (i.e., the casino) so that their winning hand does not necessarily result in a loss by a fellow player, who may be an acquaintance. Finally, traditional poker does not offer the excitement associated with "jackpot" type games. That is, a royal flush in traditional poker—as improbable as that card combination is—will result in winning only the amount in the pot and nothing more. Many players seek out games where there is some possibility of "winning big, " an option that is not available under conventional poker rules.

As a consequence of these disadvantages, casinos have introduced a variety of poker-type game variants to address the shortcomings discussed previously. One obvious advantage of these poker-type games from the casino's point of view is that the casino becomes an active participant in the game (as the house) and can, as a consequence, increase the revenue taken from the game. Additionally, these poker-type games are very attractive to many of the gambling public, and the mere fact that they are available in a particular casino has the potential to increase consumer traffic and revenue there.

A variety of innovative stratagems have been employed to make poker-type games more appealing to casino gamblers. For example, many poker-variants are designed to let the players compete against the house, rather than against each other. In other cases, progressive betting has been utilized, wherein the player may increase his or her bet during the play of a hand. This makes the game more exciting to the player and potentially more profitable for the casino. Jackpots have been introduced, wherein certain card combinations in the player's hand result in an enhanced payout to that player. Finally, computer implementations of these games is always an attractive possibility, with video based casino games becoming increasingly popular. One such video implementation of a poker-type game is taught by Weingardt, U.S. Pat. No. 5,042,818. Of course, a natural next step is to offer these same video based casino games over the Internet, thereby making the games available to a potentially enormous audience.

Poker-type games differ from counting-type games, such as blackjack, primarily in the way that winners are determined. In blackjack for example, each card in a conventional 52 card deck is assigned a numeric value and the player successively draws cards in an attempt to create a hand whose numeric value is as near to "21" as is possible without exceeding that amount. Typical rules for blackjack may be found, for example, in *Hoyle's Rules of Games*, pp. 174–177, by Morehead and Mot-Smith, 1963, and in *A Book on Casino Gambling*, pp. 57–77, by Graham and Tulcea, 1978, the disclosures of which are incorporated herein by reference. If the player's or dealer's count exceeds 21, that hand is said to be a "bust" hand and is an automatic loss for the holder of those cards. On the other hand, a two card combination consisting of an ace and a jack is a "blackjack" and is an automatic win for that hand. In blackjack, the players compete against the house, not against each other. Since the numeric value of each player's hand is separately compared with the dealer's hand, it is possible—indeed, even likely—that there will be both winners and losers among the players on the same deal.

In most casinos, a game of blackjack begins by having each player place an initial wager. The blackjack dealer then distributes two cards face-down to each player and two cards—one face up and another face down—to him or herself. After the player has examined the two dealt cards and compared those cards with the face-up dealer's card, a number of options present themselves to the player. The player may "stand" (i.e., take no further cards), draw one or more additional cards in order to increase the numeric sum of the hand, double down (a form of progressive wagering), or split the two cards. Additionally, if the dealer's face-up card is an ace, the player may elect to buy insurance against the possibility that the dealer has a blackjack. If, after the dealer's face-down card is revealed, the dealer does not have a blackjack, the player loses the amount that was paid as insurance (although he or she may go on to ultimately win that deal). If, on the other hand, the dealer has a blackjack, the player collects double the amount of insurance bought (but may still lose the amount of the original wager). The option of purchasing insurance is unique to blackjack type games and has not, heretofore, been available in poker-style games. The broad rules of blackjack are generally known to those skilled in the art and a fuller description may be found in the materials previously incorporated by reference.

What is needed, then, is a game that exploits the inherent popularity of poker but which allows players to compete against the house, rather than against each other. It should combine the best of the popular 5-card and 7-card stud poker variants and be played with multiple decks of standard playing cards. It should additionally offer game enhancements such as progressive wagering, busts, insurance, bonus hands, and progressive jackpots to make the game more exciting and attractive to gamblers. The game should be of the sort that can be played, not just in a casino environment, but also in the home either as a board game, as a computer program on a hand-held game or on a desk top, or as a pull-tab type game. It should also be amenable to computer based play over the Internet. Finally, it should be readily implemented as a slot (or video slot) machine, to appeal to the proportion of the public that particularly enjoys that sort of entertainment.

Before proceeding to a description of the instant invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

The invention disclosed herein pertains generally to a new casino game wherein one or more players compete against the house in a poker-style game which offers a number of innovations that are designed to make the game more exciting to the player. Broadly speaking, the instant invention is a multi-deck poker-style game wherein a five-card "player hand" is first dealt face-up; wherein one or more players independently wager various amounts on the same player hand; wherein a 7-card face-up "dealer hand" is then dealt; wherein the dealer makes the best 5-card poker hand from the seven dealer cards; and wherein the highest ranking of the two 5-card poker hand—dealer or player—wins, subject to the requirement that neither hand contain a "bust". Additional embodiments of this invention provide for multiple winners, progressive betting, jackpots, and insurance.

According to a first aspect of the present invention, there is provided a casino-type poker game which is preferably played at a semi-circular table with custom markings that assist in the play of the game, although other arrangements are certainly possible. The game requires the use of at least two standard 52-card decks which have been thoroughly shuffled prior to their use. Preferably, though, at least twelve 52-card decks will be shuffled together and placed within a casino "shoe" for withdrawal as needed. A casino dealer typically stands opposite at least one player and, in the preferred embodiment, as many as seven players. A novel gaming table layout that assists in the play of the game is disclosed herein for use in the casino version of the game.

Broadly speaking, the game is conducted as follows. Each player who desires to participate in the game must preferably place an ante wager. Five cards are then dealt face-up from a shoe onto the table—the player hand. All of the participant players share this single five-card hand, but these cards are never actually handled by a player, only by the dealer. The players separately wager on the player hand either as it is dealt or afterward, depending on the particular game embodiment that they are playing. Each individual player is free to formulate his or her own betting strategy and can wager more or less depending on personal taste and confidence in the cards in the player hand. The player hand is formed by the dealer into the best possible poker hand that the five cards will support by identifying pairs, three-of-a-kind, a straight, a flush, etc, according to the standard rules of poker. The dealer then deals seven cards, again face-up—the dealer hand, which is thereafter formed into the best possible five card poker hand, the two cards not used being disregarded thereafter. The highest five-card poker hand of the two then wins, provided that neither hand contains a bust as defined hereinafter, a bust resulting in an automatic loss for the hand that contains it. When two or more players are seated at the table, all players then either win or lose together. However, the amount won or lost may be different for each player, depending on that player's wagering strategy. The possibility of multiple players winning on the same poker hand is a novel feature of the instant invention. If there is a "tie" between the two hands, this is called a "push" and any amounts that have been wagered on the hand are returned to the players.

As described previously, in the preferred embodiment multiple 52-card decks are mixed together and stored in a common shoe for sequential withdrawal during the game. As a consequence, it is theoretically possible for the player's five-card hand to contain two (or more) cards of exactly the same suit and rank—for example, two cards that are both the ace of spades. Anytime that a player hand contains two matching cards (same suit and rank) the player hand busts and automatically loses. The same rule applies to the dealer. However, since the dealer has the option of discarding two cards, it will rarely happen that the dealer is forced to form a five-card hand that contains a bust. Still, if the dealer hand must contain two cards of the same suit and rank, the dealer hand also is a bust. Note that if a bust occurs in the player hand, the dealer hand will not be dealt. The possibility of a bust occurring in a poker variant is a novel feature of the instant invention.

According to a second aspect of the present invention, there is provided a poker-style game substantially as described above, but wherein a progressive betting system is used. In this case, rather than dealing all five of the player cards at one time, they are incrementally dealt and the players are offered at least one opportunity to increase their bets during the deal of the cards. The preferred progressive wagering system operates as follows:

Each player places his or her initial or ante wager. The dealer then deals two of the five player cards face up on the table.

After the two-face up cards have been dealt, each player is given the option of doubling his or her initial wager by placing twice the dollar value of the ante bet on the table. A player may double or not depending on his or her own individual betting strategy.

Two more cards are then dealt face up to the player hand and each player is afforded a final opportunity to double, which is accomplished by placing on the table a number of chips equal to four times the dollar value of the ante bet. However, if a player did not double at the first opportunity he or she will preferably not be allowed to participate in the second doubling opportunity.

After each eligible player has made a decision as to whether or not to double at the second doubling opportunity, the fifth player card is dealt face up.

The game then proceeds as described previously by dealing the 7-card dealer hand and forming the best 5-card poker hand therefrom. The amount that each player wins or loses will then depend on the total amount that player has wagered during the deal of the player hand. Note that although in the preferred embodiment the player can only increase his or her bet by doubling, the instant inventor realizes that other betting increments are certainly possible. Similarly, the timing of the progressive wagers need not be strictly after the second and fourth card have been dealt. Other choices (e.g.. after each card, after the third and fifth cards, only after all cards have been dealt, etc.) have been contemplated by the inventor.

According to a third aspect of the present invention there is provided a poker-style game substantially as described above, but wherein insurance may be purchased by a player against the possibility that the player hand will contain a bust after it is dealt. In the preferred embodiment, the insurance must be purchased before the first player hand card is dealt, the exact cost of the insurance being determined by the casino, but preferably an amount equal to the minimum ante bet for that table. Now, if a bust is dealt in the player hand and insurance has been purchased by a player, that player will lose none of the monies that have been wagered as ante or doubling bets: he or she will lose only the cost of the insurance. On the other hand, if insurance had not been purchased, a player would lose all of his or her wagered amounts.

According to a fourth aspect of the present invention there is provided a poker-style game substantially as described above, but wherein there is an optional progressive jackpot that a player may elect to become eligible for by paying a premium. If a player desires to participate in the progressive jackpot option, he or she must pay for that privilege, preferably before the first player card is dealt, the exact premium payment amount to be determined by the casino, but typically equal to $1. Thus, a player who pays the progressive jackpot premium will share equally with others who do similarly if certain predefined card combinations appear in either the player or dealer hands, an enumeration of the preferred jackpot card combinations being disclosed hereinafter. If a jackpot hand is not dealt, the player loses his or her premium.

A jackpot hand might be defined in any number of ways, but some preferred methods of so doing are as follows. First, if the player hand consists of five cards with a face value (rank) of "7," a super jackpot is announced and all players who have participated in the jackpot option will share equally in the winnings, hence the preferred name "Lucky Seven Poker," which will be used hereinafter to refer generally to the instant invention. This is in spite of the fact that at least two cards of the five are guaranteed to be the same suit and rank, which combination otherwise would be characterized as a bust hand. If the player hand contains five 7's, the dealer hand will not be dealt. Similarly, if the dealer hand consists of seven cards with a face value of "7," a super jackpot is once again declared and all jackpot participants automatically win, regardless of the cards showing in the player hand. Additionally, smaller (i.e., "regular" as opposed to "super") jackpots will be awarded if the player hand contains a royal flush, straight flush, four of a kind, full house, flush, or straight. Note in this later case, however, that two cards of the same suit and rank in the player hand will cause the hand to be classified as a bust hand, even though it would otherwise qualify as a jackpot. Thus, in the preferred embodiment the game actually boasts double progressive jackpots: super and regular.

Finally, the instant inventor contemplates that the rules that characterize the various embodiments described above may be used to fashioned a computer program to implement the game which might run, for example, on a personal computer. As an extension of this embodiment, with the proper programming expertise the computer version could be modified to operate over the Internet, allowing people world wide the opportunity to participate in the game. Additionally, the game could be implemented equally well as a video slot machine, preferably where all of the players standing at a "bank" of machines would share in a jackpot hand appearing on any one of the machines in that bank. Additionally, the same method could be made part of a "home game" version of Lucky Seven Poker. As one last suggested implementation of the instant method, the inventor contemplates that this invention might be made and sold as pull tabs.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

FIGS. 2A and 2B illustrate a flow chart of a preferred embodiment of the present invention.

DETAILED DESCRIPTION OF THE PREFERRED EMBODIMENTS

The Casino Game

Figure 1:
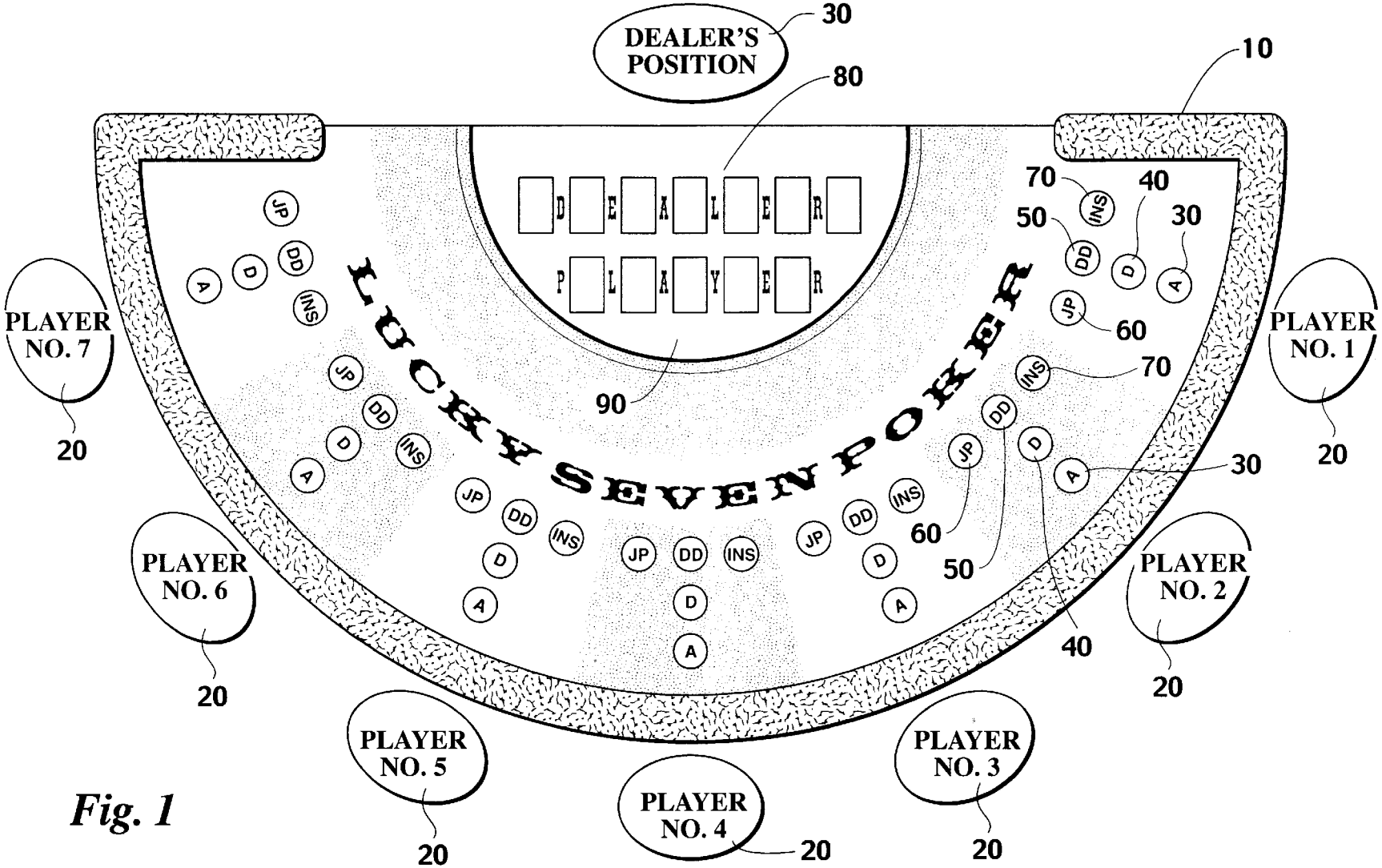
FIG. 1 is a drawing that illustrates a preferred table arrangement for playing the instant poker-type game.

Referring to the drawings in detail, wherein like numerals denote identical elements throughout the several views, there is shown in FIG. 1 a preferred table arrangement for playing Lucky Seven Poker as a casino game. As is indicated in that figure, the game is preferably played at a semi-circular gaming table 10, wherein as many as seven players 20 may be seated opposite a dealer 30. Of course, tables that accommodate more players are certainly possible and have been contemplated by the inventor. There are customized markings on the table 10 that are designed to expedite play of the game and will be discussed hereinafter. Table 10 represents the preferred playing surface, although many other suitable configurations might also be developed.

The game requires the use of at least two standard 52-card decks which have been thoroughly shuffled prior to their use. Preferably, though, at least twelve 52-card decks will be shuffled together and placed within a casino "shoe" for withdrawal as needed. The inventor has a preferred method of preparing the decks for game play which is best described as follows.

Twelve decks of new cards are acquired. A first deck is chosen from among the twelve decks. That deck is first "turned inside out" by repeatedly drawing the top and bottom cards from the deck and letting them drop into a pile. This is done most efficiently by holding the deck in one hand and placing thumb and index finger of the other hand on the top and bottom of the deck, respectively, and pulling the top and bottom cards away from the remainder of the deck. This procedure is to be repeated until the cards in this deck are exhausted (i.e., 26 times). The now reordered first deck is riffle shuffled at least four times and set aside. This process is repeated for the remaining eleven decks. Next, the twelve individually shuffled decks are formed into two six-deck piles. Finally, near equal quantities of cards (say, about 52) are selected from the top of each six-deck pile, shuffled together at least two times, and placed into the shoe to create a game deck for use in the game. This process is repeated until both six-deck piles have been shuffled together and placed into the shoe. Needless to say, although this is the preferred method of preparing the cards for the game, any accepted method of mixing together the decks and randomizing the order of the cards therein would be acceptable. After the shuffling has taken place, in the preferred embodiment one of the players seated at the game table will be afforded the opportunity to cut the game deck. This is typically done by giving a player a special "cut card" and having that player cut the game deck using that card as a pointer. Finally, the cut card will be reinserted into the game deck within one-inch of its bottom and, when it is subsequently encountered during a deal, it acts a signal that a new shoe of cards is to be obtained after the current deal is completed.

In its simplest form, the invention disclosed herein is played as follows. At least one player 20 (and as many as seven, or even more) may participate in a hand. The five cards forming the player hand 90 are dealt face-up onto the table 10 from a card shoe containing at least two shuffled decks of playing cards (the game deck). The players 20 separately wager on this single player hand 90 either as it is dealt or afterward. The player hand 90 is formed by the dealer 30 into the best possible poker hand that the five cards will support by identifying pairs, three-of-a-kind, a straight, a flush, etc, according to the standard rules of poker. The dealer 30 then deals seven cards, again face-up onto the table—the dealer hand 80. The dealer 30 forms the best possible five card poker hand from the seven cards in the dealer hand 80, discarding the two cards not used. The highest five-card poker hand between the dealer 80 and player 90 hands not containing a bust (defined hereinafter) then wins the game. When two or more players 20 are seated at the table, all players 20 then either win or lose together. However, the amount won or lost by a player 20 will be different depending on the wagering strategy of that particular player 20. If there is a "tie" between the two hands, this is called a "push" and any amounts that have been wagered on the hand are returned to the players.

Turning now to a discussion of how the game would be played in its preferred embodiment (FIG. 2), in FIG. 1 note that each player 20 sits adjacent to a "T" shaped pattern of circles, wherein letters have been printed. The preferred progressive betting game play sequence utilizes these circles as follows.

In order for a player 20 to participate in a hand, one or more chips must be placed within the "A" circle 30 before the first card in the player hand 90 is dealt—this is the ante bet (event 520). The dealer 30 then deals two of the player hand cards face up on the table (event 570).

Each participating player 20 at the table, after studying the two dealt cards, is then given the option of doubling his or her initial wager (decision item 630) by placing within the D circle 40 an amount equal to twice the dollar value of the ante bet (event 520).

Two more cards are then dealt face up (event 660) to the player hand 90 and each player 20 is afforded a final opportunity to double the wager (decision item 690), which is accomplished by placing within the DD circle 50 a number of chips equal to twice the dollar value of the DD wager (event 700), making the total amount wagered equal to seven times the ante bet. However, if a player 20 did not double at the first opportunity he or she will not be allowed to participate in the second doubling opportunity (branch 640).

After each eligible player 20 has made a decision whether or not to double at the second doubling opportunity, the fifth player card is dealt face up (event 710) and formed into the best possible poker hand by the dealer (event 790).

The seven cards in the dealer hand 80 are then dealt (event 880) and the best 5-card poker hand is constructed from the dealer's cards (event 820), subject to the requirement that the dealer hand 80 cannot contain a bust.

The winning hand is then determined using the standard poker hand hierarchy, subject to the possible appearance of a bust in one hand or the other, a bust being discussed hereinafter.

It should be apparent to those skilled in the art that, due to the multiplicity of wagering options in this preferred embodiment, it is possible that each player 20 will have a different financial stake in the outcome of a hand. As a consequence, each player 20 will then also stand to gain a different amount if the player hand 90 wins. Additionally, it is certainly possible to play this game without wagering taking place, in which case the participants would be playing for pure enjoyment. The instant inventor contemplates that, in that instance, neither an ante wager, nor the doubling wagers, would be required.

The player hand 90 may lose to the dealer hand 80 either by containing an inferior poker hand (event 920) or by busting. A bust is produced as follows. In the preferred embodiment, multiple 52-card decks are mixed together and stored in a common shoe for sequential withdrawal during the game. As a consequence, it is theoretically possible for the player's five-card hand 90 to contain two (or more) cards of exactly the same suit and rank—for example, two cards that are both the ace of spades. Anytime that a player hand contains two matching cards (same suit and rank) the player busts and automatically loses (decision items 580, 670, and 720 in FIG. 2). The same rule applies to the dealer. However, since the dealer has the option of discarding two cards, it will rarely happen that the dealer is forced to form a five-card hand that contains a bust. Still, if the dealer hand 80 must contain two cards of the same suit and rank, the dealer hand also is a bust (decision item 830) and the player hand 90 wins the game. The possibility of a bust occurring during the play of the poker-type game is a novel feature of Lucky Seven Poker. Additionally, in the preferred embodiment the five player cards 90 are dealt and examined before the dealer's cards are placed on the table. If the player hand 90 contains a bust, the seven cards in the dealer hand 80 would not be dealt in the preferred embodiment. However, if the dealer hand 80 is dealt after a player hand 90 bust, as certainly could be the case in some variations of the instant invention, the winning hand would preferably be resolved according to the following rules:

If the player hand 90 contains a bust, the player 20 loses. This is true even if there is a bust in the dealer hand 80.

If the dealer hand 80 contains a bust and the player hand 80 does not contain a bust, the dealer 30 loses.

The remaining betting circles—the "JP" circle 60 and the "INS" circle 70—implement two other novel features of the instant invention. Before the first player card is dealt, each player has the option of purchasing insurance (decision item 530) against a bust in the player hand 90 by placing $1 (or some other amount determined by the casino) in the INS circle 70. In the preferred embodiment, the cost of the insurance will be the same as the minimum ante allowed for that game, if the minimum ante is less than or equal to $1, or equal to $1 if the minimum ante is greater than $1. Thus, insurance in a 50 cent minimum ante game would cost 50 cents, whereas insurance in a $10 minimum ante game would cost $1. If a bust is dealt and insurance has been purchased by a player (event 620 in FIG. 2), that player will lose none of the monies that have been wagered in the A 30, D 40, and DD 50 circles: he or she will only suffer a loss equal to the cost of the insurance ($1). If, on the other hand, insurance had not been purchased, a player 20 would lose all of his or her wagered amounts (event 610).

Figure 2A:
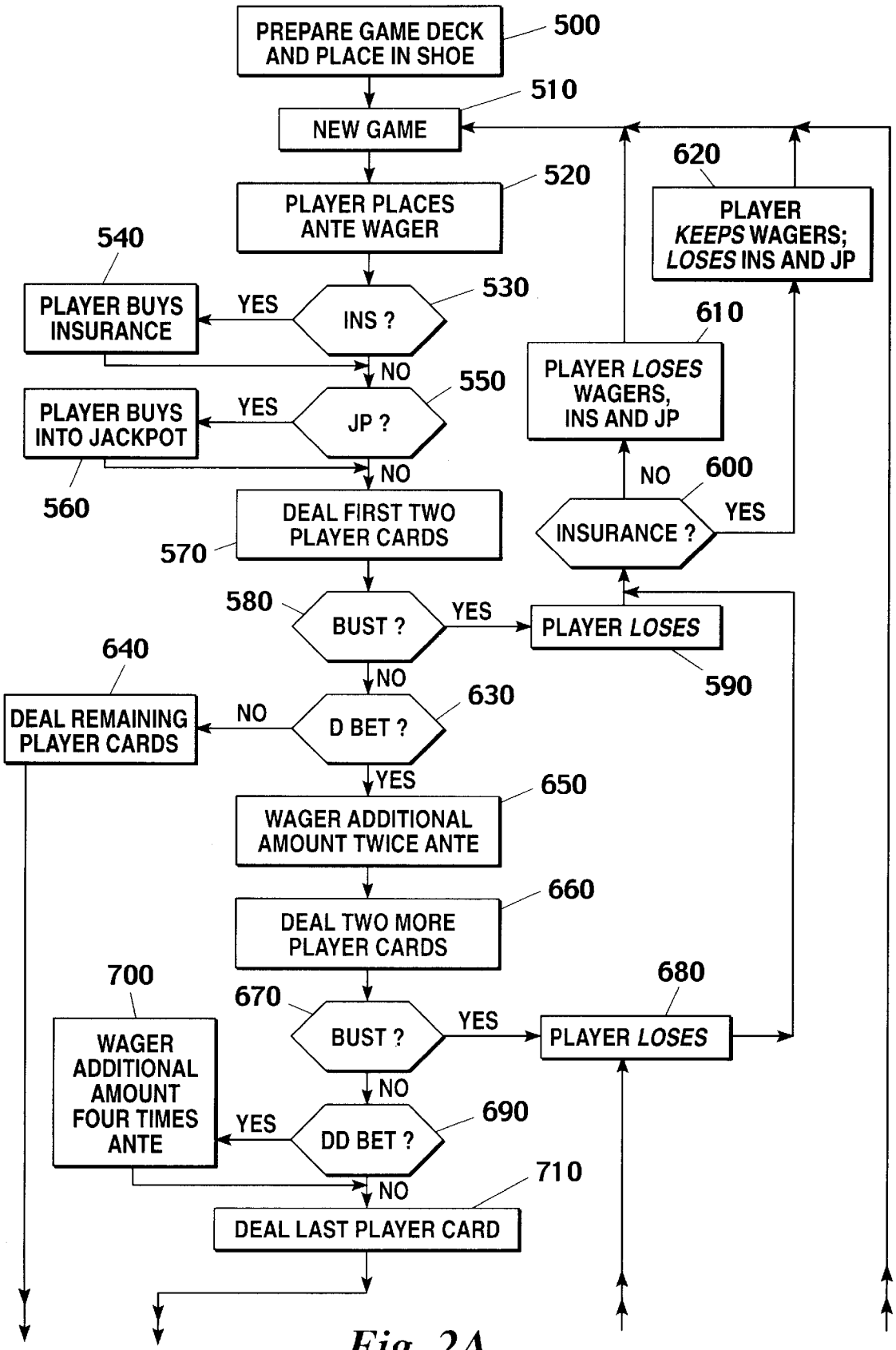

Finally, if a player 20 places the proper amount within the JP circle 60 before the start of the play of a hand, that player will be eligible to share in a progressive jackpot if the appropriate cards are dealt, a progressive jackpot being one that increases incrementally in size until someone wins it (see decision item 550 in FIG. 2). If a jackpot hand is dealt, every player 20 at the table 10 that has paid for the opportunity will share in the winnings (flowchart items 760 and 890). If a jackpot hand does not appear, the player 20 loses his or her payment, typically $1. The cost to become eligible to participate in the jackpot will preferably be the same as the minimum ante allowed for that game, if the minimum ante is less than or equal to $1, or equal to $1 if the minimum ante is greater than $1. Thus, jackpot eligibility in a 50 cent minimum ante game would cost 50 cents, whereas jackpot eligibility in a $10 minimum ante game would cost $1. In the preferred embodiment, two sorts of progressive jackpots will be offered: super and regular. The table that follows describes the card combinations that will result in the occurrence of a super jackpot hand:

| Super Jackpot | Payout |
|---|---|
| Dealer's hand 90 Contains 7 sevens | 100% |
| Player's hand 80 Contains 5 sevens | 100% |

In the previous table "100%" means that if this card combination is dealt, the entirety of the amount that has accumulated in the progressive jackpot will be disgorged and divided equally among all of the players 20 that had elected to participate in the jackpot before the hand began. If the dealer's hand 80 consists of seven cards with a face value of "7," a super jackpot (event 740) is announced and all who have participated in the jackpot option (JP 60) share the winnings. (This is in spite of the fact that at least two cards of the seven are guaranteed to be the same suit and rank, which combination otherwise would be characterized as a bust hand). Similarly, if the player hand 80 consists of five cards with a face value of "7," a super jackpot (event 740) is again declared.

Although the jackpot offered in connection with the game disclosed herein need not be progressive, many gamblers are drawn to games that offer such a jackpot. Preferably, the progressive jackpot will be funded by allocating some percentage of the money collected from players participating in the game jackpot option (JP 60) to the jackpot. For example, the jackpot might be funded by taking 25% of each dollar placed in the jackpot circle 60. The remainder of the jackpot money collected in this manner would either go to the house or, preferably, to fund a second progressive jackpot. If the game is widely played, a progressive jackpot can potentially grow to be a substantial size.

A regular (as opposed to super) progressive jackpot (decision items 750 and 870 in FIG. 2) is also preferably provided in connection with some more common card combinations. Smaller jackpots (discussed hereinafter) will be awarded if the player hand contains a royal flush, straight flush, four of a kind, etc. Note in this case, however, that two cards of the same suit and rank in the player hand 90 will cause the hand to be classified as a bust hand, even though it would otherwise qualify as a jackpot. This second progressive jackpot accumulates money separately from the super jackpot and might by funded by some portion of each dollar paid into the jackpot option (JP 60), for example 25%. As before, if the player hand 90 contains one of the following jackpot card combinations, the dealer hand 80 will not dealt.

| Regular Jackpot | Payout |
|---|---|
| Royal flush in p1ayer's hand | 100% |
| Straight flush in player's hand | 10% |

The value "10%" means that if a straight flush is dealt in the player hand 90, 10% of the amount in the progressive jackpot will be divided by the participants. In the event of a royal flush in the player hand's, the dealer's hand will not be dealt. However, a jackpot associated with a straight flush in the player hand 90 will only be paid if that hand subsequently beats the dealers hand (decision item 870). In the later case, all players 20 who paid for the privilege will share equally in 10% of whatever amount has accumulated in the regular progressive jackpot. These payout percentages, of course, are only examples of the sort of payout that a casino might choose to offer.

Finally, some additional fixed jackpot amounts are provided for certain card combinations in the player's hand (decision item 870). Funds to pay these amounts will preferably be drawn from the second (or regular) progressive jackpot fund.

| Regular Jackpot | Payout |
|---|---|
| Four of a kind | $500 |
| Full house | $100 |
| Flush | $50 |
| Straight | $25 |

In order for the participants to collect these amounts they must have bought into the jackpot option 60 and the player hand 90 must beat the dealer's hand 80. Thus, a flush in the player's hand 90 which is opposite a full house in the dealer's hand 80 will not qualify to collect the jackpot amount: the players 20 will instead lose their wagers.

It is common in casino games to offer enhanced payouts when the player beats the dealer with certain card combinations (event 860). The table that follows contains some preferred bonus amounts which will be paid independently of any jackpot amounts.

| Bonus | Payout |
|---|---|
| Dealer's hand contains 7 sevens | 200 to one |
| Player's hand contains 5 sevens | 200 to one |
| Royal Flush | 100 to one |
| Straight flush | 50 to one |
| Four of a kind | 25 to one |
| Full House | 11 to one |
| Flush | 8 to one |
| Straight | 5 to one |
| 3 of a Kind | 3 to one |
| Two pair | 2 to one |
| Pair/High hand | 1 to one |

The notation "200 to one" means that a player will win 200 times the total of the amounts wagered in the A 30, D 40, and DD 50 circles. For example, if the player hand 90 shows a Royal Flush and the dealer hand 80 is anything less, a wager of $2 in the ante circle 30, $4 in the D circle 40, and $8 in the DD circle 50, would result in a payout of $1400 (i.e., 100 times 2 plus 4 plus 8). Note that a player 20 receives this amount whether or not he or she has participated in the jackpot option 60. A player 20 would be paid an additional amount for this card combination if he or she had participated in the jackpot option, however.

Additionally, in the preferred embodiment the inventor contemplates that certain card combinations in the player hand 90 may constitute a "Lucky Seven" jackpot, which is different from the jackpot hands discussed previously. For example, whenever the player hand 90 is dealt the seven of diamonds and the seven of hearts as a pair and the hand loses without busting, the dealer 30 will pay $50 to each of the players 20. On the other hand, if the player hand 90 wins with this card combination, each of the players 20 receives seven times his or her bet (decision items 880 and 950). This amount is in addition to any bonus payout. By way of illustration, suppose that the player hand 90 contains a full house consisting of three queens and the seven of diamonds and seven of hearts. Assume further that this hand is superior to the dealer hand 80. A player who had wagered a total of $7 would then collect: $100 for the full house bonus plus $77 (11 times $7) for the Lucky Seven payout.

Finally, it should be clear to those skilled in the art that the "casino game" embodiment described above can easily be adapted for use in the home. The inventor contemplates that a printed playing surface similar to that depicted in FIG. 1 could be provided with each sale of a game. The players in the home version might alternate being the dealer, or one player could act as the dealer for the entire evening.

The Video Embodiment

Figure 3:
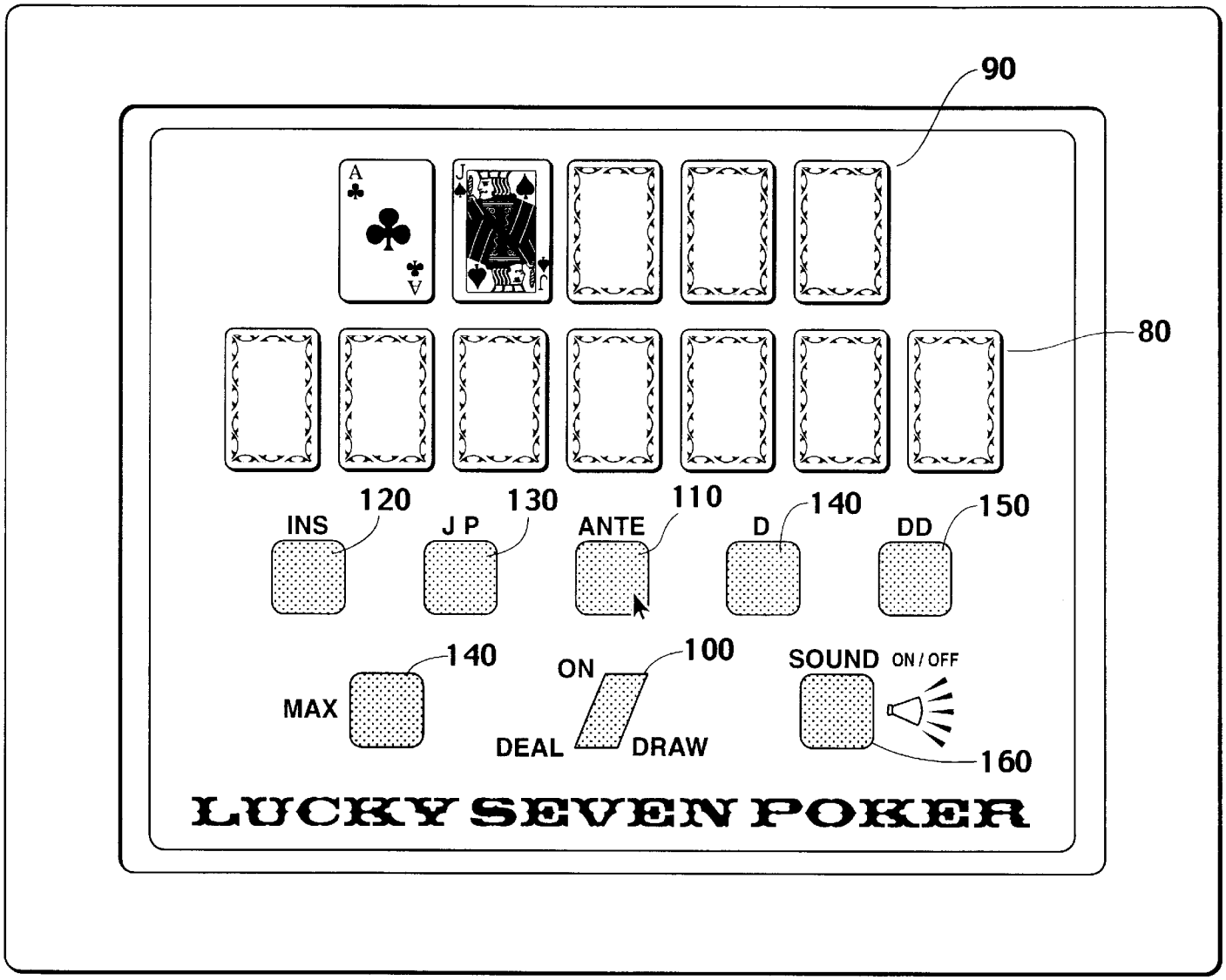
FIG. 3 illustrates how the instant invention would be implemented within a computer.

As is illustrated in FIG. 3, the game described herein may be readily programmed for play on a computer (either locally or over a network such as the Internet) or on a custom manufactured video slot machine. In the text that follows, the term computer will be used in the broad sense to apply to any number of devices that consist of at least a CPU connected to a display device. The CPU and display device need not be directly physically connected, but instead might be connected via a network. Additionally, "play on a computer" as used herein is also meant to include game play implemented via the client-server model as that term is known to those skilled in the art, wherein a remote computer program generates text and graphics that are sent via a network to a local CPU/display combination (the client). The local client then interacts with the end user and sends information obtained from the user back to the server for subsequent processing. Finally, it is well known to those skilled in the art that a computer program, once it is written, might be stored on any number of media for recall and loading into computer RAM for game play upon initiation of a game by a player. These media might include, but are not limited to magnetic tape, magnetic disk, magneto-optical disk, optical disk, a CD-ROM, computer ROM, and non-volatile computer RAM magnetic tape, magnetic disk, magneto-optical disk, optical disk, a CD-ROM, computer ROM, and non-volatile computer RAM.

FIG. 3 represents the face of a computer monitor, upon which are displayed the graphical indicia necessary to play the invention disclosed herein. When the player first encounters the game, it would preferably display 12 "card backs" on the screen, these cards representing 12 down-turned cards (i.e. the player hand 90 and the dealer hand 80). The game would be initialized by having the player activate the "on" button (ON-DEAL-DRAW 100). If the game is played at home on a conventional PC, the ON-DEAL-DRAW button 100 would be pressed by positioning an on-screen pointer (e.g., a mouse pointer) over the over the area of the screen representative of the button 100 and then "clicking" a button (e.g., a button on a mouse), thereby selecting that option. Those skilled in the art will recognize that a pointing/selecting device other than a mouse could alternatively be used. Additionally, if the game is being played on a custom manufactured video slot machine, there would most likely be provided actual physical buttons labeled similar to those in FIG. 3 that the player could depress at the appropriate moment. Thus, although the text that follows will be couched in terms of a computer implementation with on-screen button regions, those skilled in the art will recognize that these on-screen buttons can alternatively be implemented as actual physical buttons.

After initiating the game, the player would next be prompted to tender sufficient funds to at least cover the ante bet. The ANTE button 110 would then be pressed to signify the proper amount had been wagered. In the event that the game is being played for recreation as a stand-alone program on an individual's home computer, obviously no real money would need be wagered: in that case the wager would be $0. The program would next determine whether the player wants to purchase insurance and become eligible to participate in the jackpots. By activating the INS 120 and JP 130 buttons, the player would select insurance and jackpot eligibility, respectively. If sufficient funds had not been deposited in the machine to cover the selection of these options, the program would prompt the player to deposit additional funds. Alternatively, the player may press the MAX 140 button to signal to the program that he or she wishes to accept the default ante amount for this machine, purchase insurance, and buy into the jackpot.

The player preferably would signal to the computer that he or she is ready for the hand to begin by pressing the "on" button (ON-DEAL-DRAW 100). (The SOUND 160 button has been provided so that a player may choose to hear or not sound affects and/or music that might accompany the play of the game). The computer would then "deal" the first two cards in the player hand 90 on the screen by exhibiting graphic representations of playing cards in the positions where two card-backs had been displayed previously. FIG. 3 specifically illustrates the screen as it would appear after the first two player cards have been revealed. Of course, those skilled in the art know that the dealt cards would not be drawn from a deck in any physical sense, but rather a computer program would generate random numbers which would then be used to extract representations of playing cards from a listing of possible card values. In the preferred embodiment, the computer would randomly draw cards without replacement from an electronic "deck" of cards composed of multiple 52-card decks. The cards drawn according to this scheme will then be displayed on the screen for the player's review.

As in the casino version of the game, the player will be offered the opportunity to double the initial player wager. This will be signaled to the computer by activating the D 140 button. If the player has not deposited sufficient funds to cover the doubled bet, the machine will prompt the player to do so. Otherwise, the player will be able to move the game forward without doubling at this juncture by pressing the "draw" button (ON-DEAL-DRAW 100). Of course, if the player does not participate in the first doubling opportunity, he or she will not be offered a second chance to double.

After the player has made a decision with respect to the first doubling opportunity, the screen will change to reveal two more cards in the player hand 90. Once again, the player will be given the option of doubling and may indicate a desire to do so by activating the DD 150 button or, in the alternative, by pressing the "deal" button (ON-DEAL-DRAW 100), indicating that the computer is to proceed without a doubling bet being wagered.

After the final possible doubling opportunity has passed, the computer will deal the last card in the player hand 90 and check for busts and the presence of a super progressive jackpot. If there is no bust or jackpot, the dealer hand cards 80 will be revealed by displaying card images on the screen place of the face-down cards. The best poker hand that can be formed from the dealer hand 80 will be determined, subject to the limitations of the game as previously described. The winning hand (player 90 or dealer 80) will be indicated on the screen and winnings due to the player will be distributed. If the player has lost the hand, the screen will reset to display 12 face-down cards, after giving the player time to confirm the loss by examining the cards for him or herself. The player who is in a hurry, however, can initiate a new deal by pressing the "deal" button (ON-DEAL-DRAW 100), thereby clearing the old card images and starting a new game.

Over the Internet, the program would be implemented in exactly the same fashion described previously for a computer/slot machine, except that, rather than having the player physically deposit coins money into a machine, the player would first pass through a secured web page (or some similar arrangement) that would extract credit card information from the prospective player. After that, screen play would proceed in a manner substantially similar to that described previously, with the player's credit card being debited and credited as the game progressed. A progressive jackpot payout might possibly be handled differently because of the size of the funds involved. It is also possible that the game might be offered over the Internet in a "fun" or learning mode, wherein no funds would be wagered (e.g., all wagers would either be equal to $0 or the player might be allowed to wager "imaginary" dollars. In the later case, the computer would track the player's wagers, but loses would never be collected nor would winnings be paid). This might be done to introduce new players to the game.

Exactly the same game progression would apply if Lucky Seven Poker were implemented as a hand-held LCD gaming device—a device that contains, at its core, a computer CPU. In that case, dedicated buttons for INS 120, JP 130, etc., would probably be provided on the face of the unit.

Finally, the instant inventor contemplates that this game would best be offered as a "bank" or collection of a number of related slot machines. In that instance, a jackpot hand on one machine would result in jackpot payouts on all related machines wherein the player had paid to participate in the jackpot option.

The Pull-Tab Embodiment

Finally, the instant inventor contemplates that "Lucky Seven Poker" can be implemented as a "pull-tab" gaming device. A pull-tab is a popular and relatively inexpensive gambling device sold in most establishments where gambling occurs and, in some states, in (non-gambling) retail establishments such as convenience stores. Pull-tabs (also known as "break-open" cards) are similar in appearance to a lottery ticket, except that they are made from two rectangular pieces of poster board which are glued together. The two poster board pieces are pulled apart by the purchaser to reveal a previously concealed interior surface upon which is printed words, letters, numbers, or symbols that may indicate the purchaser has won a monetary prize. In some instances, there may be one or more windows in the front face of the pull tab and the purchaser "opens" each window by tearing open a small perforated section, each window thereby opened revealing a portion of the concealed information printed underneath. After all of the windows have been opened in this manner, the purchase will be able to determine whether or not he or she has won a monetary prize.

In the preferred pull-tab embodiment, the interior of each ticket will be printed with a 7-card dealer hand 80 and a 5-card player hand 90, preferably adorned with graphical embellishments designed to make its appearance similar to the table top 10 depicted in FIG. 1, but wherein the open rectangles representing the dealer hand 80 and player hand 90 are filled with "face-up" playing cards. The winning poker hand, either player's or dealer's, will be indicated in some fashion so that a purchaser who is unfamiliar with the rules of poker will immediately know whether or not he or she has a winning ticket. This might be done, by way of example only, by printing the winning hand in bold type, circling the winning hand, printing an arrow that points to the winning hand, etc. If the printed player's hand 90 beats the dealer's hand 80, the pull-tab is a winner for the purchaser and can be redeemed for a cash value at the place of purchase (except possibly for those instances in which a jackpot or progressive jackpot is triggered and wherein a large sum of money is to be returned to the player). As described previously, certain card combinations in the printed player and dealer hand will result in a super jackpot, a jackpot, or a bonus payout. Additionally, busts will be considered in determining the winner between the two hands. However, since both the dealer and the player hands will preferably be printed on the ticket, busts in the dealer 80 and player 90 hands will be resolved as follows:

If the player hand 90 exhibits a bust, the pull-tab purchaser loses. This is true even if there is a bust in the dealer hand 80.

If the dealer hand 80 exhibits a bust and the player hand 80 does not contain a bust, the pull-tab purchaser wins.

Finally, it is possible, though not essential, that a double progressive jackpot system might be implemented for pull-tabs. By apportioning some fraction of the purchase price of each pull-tab sold to a progressive jackpot, a pool can be created whereby a player could possibly win a large sum of money from the purchase of a single game piece.

Example Hands

As further illustrations of how the instant game operates in practice, this section contains some example hands together with descriptions of how the winner and payout are determined with respect to the rules disclosed herein. The first two examples illustrate the progression of play in a typical hand. Subsequent examples will focus more on the interpretation of the cards resulting from the deal. Additionally, the examples that follow will be discussed from the standpoint of a single player, although in the preferred embodiment multiple players would be involved, each of which may have formulated his or her own bidding strategy with respect to the player hand.

Example Hand #1:

For purposes of illustration, assume that both the insurance and jackpot options have been purchased: $1 for insurance and $1 for the jackpot. Assume further that the ante bet for this game is $1. Additionally, suppose that the first two cards dealt to the player hand are: K♠ 9♦.

The player is next given the opportunity, in light of the first two cards, to double the initial bet: the game is halted until the player makes that decision. Assume further that the player doubles the initial bet and places $2 in the D circle. The next two cards dealt to the player hand are: 9♣ 9♥, making the entire player hand so far: K♠ 9♦ 9♣ 9♥.

The player is given a final opportunity to double his or her bet. Assume that the player does so by placing $4 in the DD circle. The last card is then dealt to the player: K♥, resulting in final player hand 90 that is a full house (two kings and three 9's). A full house potentially qualifies for the regular progressive jackpot ($100) and for an 11 to one payout (11 times $7 wagered)—if the player hand 90 beats the dealer hand 80.

Next the dealer hand is produced. Suppose that the dealer hand is: 4♣ 4♣ 4♠ 4♦ 7♥ J♥ A♣. The best 5-card poker hand that can be made from these seven cards is three (not four) of a kind: 4♣ 4♠ 4♦ J♥ A♣. This is because one of the two 4♣ cards must be discarded, otherwise the dealer hand would contain a bust. The entire deal is illustrated in the table that follows:

| A | D | DD | JP | INS | Card | 1 | 2 | 3 | 4 | 5 | 6 | 7 |
|---|---|---|---|---|---|---|---|---|---|---|---|---|
| $1 | $2 | $4 | $1 | $1 | Player | K♠ | 9♦ | 9♣ | 9♥ | K♥ | | |
| | | | | | Dealer | 4♣ | 4♣ | 4♠ | 4♦ | 7♥ | J♥ | A♣ |

Thus, the player hand wins the deal (a full house beats three of a kind). The player in this example would collect $100 (because he or she paid to participate in the jackpot), plus $77 (11 to one bonus for a full house), making a total winnings of $177. From this amount, the player must subtract the $2 paid to insurance and to join the jackpot, resulting in net winnings of $175 on this hand.

Example Hand #2:

Assume that the player has bought insurance but not participated in the jackpot option, and has paid a $1 ante. The first two player cards are 10♣ 10♠. The player elects to double the bet by placing $2 within the "D" circle.

Assume further that the next two cards are K♥ 5♥ and that the player elects to double again by placing $4 within the "DD" circle.

If the final player card is a 10♠, the entire player hand would be: 5♥ 10♣ 10♠ 10♠ K♥. In this case the player hand is a bust because it contains two cards of the same suit and rank. Thus, the player hand 90 automatically loses and the dealer's hand 80 will not be dealt. However, since the player purchased insurance, all of the sums wagered will be returned to the player: $7. The player's only loss is the $1 paid for the insurance.

| A | D | DD | JP | INS | Card | 1 | 2 | 3 | 4 | 5 | 6 | 7 |
|---|---|---|---|---|---|---|---|---|---|---|---|---|
| $1 | $2 | $4 | $0 | $1 | Player | 10♣ | 10♠ | K♥ | 5♥ | 10♠ | | |
| | | | | | Dealer | | | | | | | |

Note that the dealer hand is not dealt in this case because the player hand contains a bust.

Example Hand #3

Consider the following example deal:

| A | D | DD | JP | INS | Card | 1 | 2 | 3 | 4 | 5 | 6 | 7 |
|---|---|---|---|---|---|---|---|---|---|---|---|---|
| $1 | $2 | $4 | $0 | $1 | Player | K♣ | Q♠ | 7♥ | 3♦ | 8♦ | | |
| | | | | | Dealer | A♠ | 3♣ | 10♥ | 9♥ | 8♥ | 3♠ | A♦ |

the player hand (king high card in hand) loses to the best five-card dealer hand (two pair—aces and threes). The player loses $8—the wagers and $1 for insurance.

Example Hand #4

In the following game,

| A | D | DD | JP | INS | Card | 1 | 2 | 3 | 4 | 5 | 6 | 7 |
|---|---|---|---|---|---|---|---|---|---|---|---|---|
| $1 | $2 | $4 | $1 | $1 | Player | 3♦ | 4♣ | 2♣ | 5♠ | 6♠ | | |
| | | | | | Dealer | K♥ | 7♠ | J♣ | 3♠ | 8♣ | 6♣ | K♣ |

the player hand (a straight, six high) wins to the best five-card dealer hand (a pair of kings). The player will collect five times his or her wager (a bonus payout of 5 times $7 or $35) plus an additional $50, since the player participated in the jackpot. The player gains a total of $83 ($85 minus one dollar each for the jackpot and insurance).

Example Hand #5

A push is illustrated in the game hands that follow:

| A | D | DD | JP | INS | Card | 1 | 2 | 3 | 4 | 5 | 6 | 7 |
|---|---|---|---|---|---|---|---|---|---|---|---|---|
| $1 | $2 | $4 | $1 | $1 | Player | Q♥ | 5♠ | 3♠ | 10♣ | 2♦ | | |
| | | | | | Dealer | 6♣ | 7♦ | J♦ | 3♠ | 8♣ | 2♥ | Q♣ |

the player hand (queen high in hand) ties with the best five-card dealer hand (queen high in hand), i.e., a push. All of the player's wagers will be returned ($7 in this case), however the player will lose the amount paid to insurance and to purchase eligibility for the jackpot, a total of $2.

Example Hand #6

In the following game,

| A | D | DD | JP | INS | Card | 1 | 2 | 3 | 4 | 5 | 6 | 7 |
|---|---|---|---|---|---|---|---|---|---|---|---|---|
| $1 | $2 | $4 | $1 | $1 | Player | Q♠ | 9♠ | J♠ | 10♠ | 8♠ | | |
| | | | | | Dealer | | | | | | | |

the player hand (queen-high straight flush in spades) qualifies as a jackpot hand. The player, having elected to participate in the progressive jackpot, will split 10% of the amount in the progressive jackpot with all others at the table who paid for the same privilege on this hand. Note that the dealer cards are not dealt in this instance.

Example Hand #7

Consider the following hand that illustrates the requirement that the best-five card dealer hand cannot contain a bust:

| A | D | DD | JP | INS | Card | 1 | 2 | 3 | 4 | 5 | 6 | 7 |
|---|---|---|---|---|---|---|---|---|---|---|---|---|
| $1 | $2 | $4 | $1 | $1 | Player | K♥ | J♥ | 4♥ | 5♥ | 9♥ | | |
| | | | | | Dealer | 3♣ | 3♦ | 3♦ | 3♠ | 8♣ | 2♥ | 8♣ |

Additionally, the player hand (flush in hearts) would normally qualify for a $50 jackpot award. However, since the player hand loses to the best five-card dealer hand (a flush—threes and eights) no jackpot will be awarded. Note that the dealer was forced to discard one of two diamond threes to avoid a bust. All of the player's wagers will be lost ($7 in this case) in addition to the jackpot and insurance amounts, for a total loss of $9.

Example Hand #8

In the following game,

| A | D | DD | JP | INS | Card | 1 | 2 | 3 | 4 | 5 | 6 | 7 |
|---|---|---|---|---|---|---|---|---|---|---|---|---|
| $1 | $2 | $4 | $1 | $1 | Player | 8♥ | J♠ | 10♣ | 9♣ | 4♦ | | |
| | | | | | Dealer | 5♣ | 5♣ | 3♦ | 3♦ | 8♥ | 8♥ | K♣ |

the player hand (jack high) automatically wins because a five card poker hand cannot be formed in the dealer hand without including two cards of the same suit and rank, i.e., the dealer busts. All of the would win an amount equal to the total wagered (i.e., $7 in this case) and would lose the insurance and jackpot payments.

Even though Lucky Seven Poker has been referred to previously as a "casino game," that term has been used in the broader sense of describing a game which can be played in a casino and which a casino might have some interest in offering to its clients. It has not been used to limit in any way the field of application of the instant invention to casinos only. As described previously, the instant inventor contemplates that his invention will be offered to the public as a board game for use in the home, implemented as a video slot machine in a gambling casino, embodied in a hand-held LCD-type game, implemented as software that runs on a personal computer, offered for play over the Internet, and incorporated into pull tabs, among many other possible modes of implementing the game disclosed herein.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. A method of playing a card game, wherein at least two conventional decks of fifty-two playing cards have been shuffled together to form a single game deck, comprising the steps of:

(a) at least one player initiating the card game;

(b) dealing five playing cards from said game deck, thereby forming a player hand, said five playing cards being dealt face-up;

(c) determining whether said player hand contains two or more cards of a same suit and rank, said two or more cards of a same suit and rank, if present, indicating a bust in said player hand;

(d) declaring a player hand loss if said player hand contains a bust;

(e) dealing seven playing cards from said game deck to form a dealer hand only if said player hand did not contain a bust, said seven playing cards being dealt face-up;

(f) selecting five cards from said dealer hand to form a best possible dealer poker hand which does not contain two matching cards of a same suit and rank, if that is possible;

(g) determining whether said best possible dealer poker hand contains two or more matching cards of a same suit and rank, said two or more cards of a same suit and rank, if present, indicating a bust in said best possible dealer poker hand;

(h) declaring a player hand win if said best possible dealer poker hand contains a bust;

(i) determining which of said player hand and said best possible dealer poker hand contains a higher ranking poker hand only if neither said player hand nor said dealer hand contains a bust, and, (i1) declaring a player hand win if said player hand contains said higher ranking poker hand, (i2) declaring a player hand loss if said best possible dealer poker hand contains said higher ranking poker hand, and, (i3) declaring a push if neither said player hand nor said best possible dealer poker hand contains a higher ranking poker hand.

2. A method of playing a card game according to claim 1, wherein step (a) includes the step of requiring each player to place at least an ante wager.

3. A method of playing a card game according to claim 2, wherein step (a) includes the step of allowing each player to purchase insurance against a bust in said player hand.

4. A method of playing a card game according to claim 3, wherein step (a) includes the step of allowing each player to purchase eligibility for at least one jackpot, each of said at least one jackpots being awarded or not depending on the occurrence of one or more predetermined card combinations in said dealer hand or said player hand.

5. A method of playing a card game according to claim 4, wherein step (b) includes the steps of:

(b1) Dealing two player cards face-up, (b2) Allowing each player to place a second wager, (b3) Dealing two more player cards face-up, (b4) Optionally allowing each player to place a third wager, and, (b5) Dealing a fifth player card face-up, thereby forming a player hand.

6. A method of playing a card game according to claim 5, wherein step (b2) includes the step of allowing each player to place a second wager that is equal in amount to twice said ante wager.

7. A method of playing a card game according to claim 6, wherein step (b4) includes the step of optionally allowing each player to place a third wager that is equal in amount to four times said ante wager.

8. A method of playing a card game according to claim 5 including the further steps of (j) resolving each player's wagers by, (j1) paying to each player a predetermined amount relating to a total of each player's ante wager, second wager, and third wager, if a player hand win is declared, (j2) returning to each player an amount equal to a total of each player's ante wager, second wager, and third wager, if a push is declared, (j3) returning to each player an amount equal to a total of that player's ante wager, second wager, and third wager, if that player purchased said insurance against a player hand bust and there was a bust in the player hand, and (j4) paying to each player a predetermined share of a jackpot amount if a jackpot hand is dealt and that player purchased eligibility for said at least one jackpot.

9. A method of playing a card game according to claim 8, wherein said jackpot hand includes a card combination in said player hand consisting of five cards of rank 7.

10. A method of playing a card game according to claim 9, wherein said jackpot hand includes a card combination in said dealer hand consisting of seven cards of rank 7.

11. A method of playing a card game according to claim 8, wherein said jackpot hand includes a card combination in said player hand consisting of a royal flush or a straight flush.

12. A method of playing a card game according to claim 8, wherein step (j4) includes the additional step of requiring that a player hand win be declared before said jackpot amount is paid.

13. A method of playing a card game according to claim 12, wherein card combinations in said player hand elgible for said jackpot hand are selected from the group consisting of a four-of-a-kind, a full house, a flush, or a straight.

14. A method of playing a card game according to claim 4 wherein at least one of said at least one jackpots is a progressive jackpot.

15. A method of playing a card game according to claim 14 wherein there are at least two progressive jackpots, said at least two progressive jackpots including a regular jackpot and a super jackpot.

16. The process of claim 1, wherein at least steps (b) through (i) are digitally encoded as a set of instructions for programming a computer and further including the step of loading said instructions on said computer before performing steps (b) through (i).

17. A device adapted for use by a digital computer wherein a plurality of computer instructions defining the process of claim 16 are encoded, said device being readable by said digital computer, and said computer instructions programming said computer to perform said process.

18. The device of claim 17, wherein said device is selected from the group consisting of a magnetic tape, a magnetic disk, a magneto-optical disk, an optical disk, a CD-ROM, computer ROM, and non-volatile computer RAM.

19. A method of playing a card game on a digital computer, wherein a method of playing a card game is programmed, wherein is provided an electronic representation of a game deck, said game deck consisting of representations of at least two conventional decks of fifty-two playing cards that have been shuffled together, and wherewith is provided a display device for displaying at least representations of playing card faces, a digital computer programmed to perform a process comprising the steps of:

(a) requiring a player to initiate the card game by tendering an ante wager;

(b) electronically dealing five playing cards from said game deck, thereby forming a player hand;

(c) presenting to said player on said display device a representation of said five playing cards forming said player hand;

(d) determining whether said player hand contains two or more playing cards of a same suit and rank, said two or more playing cards of a same suit and rank, if present, indicating a bust in said player hand;

(e) declaring a player loss if said player hand contains a bust;

(f) electronically dealing seven playing cards from said game deck only if said player hand did not contain a bust, thereby forming a dealer hand;

(g) presenting to said player on said display device a representation of said seven playing cards forming said dealer hand;

(h) selecting five playing cards from said dealer hand to form a best possible dealer poker hand which does not contain two matching cards of a same suit and rank, if that is possible;

(i) determining whether said best possible dealer poker hand contains two or more matching cards of a same suit and rank, said two or more cards of a same suit and rank, if present, indicating a bust in said best possible dealer poker hand;

(j) declaring a player win if said best possible dealer poker hand contains a bust;

(k) determining which of said player hand and said best possible dealer poker hand contains a higher ranking poker hand, and, (k1) declaring a player win if said player hand contains said higher ranking poker hand, (k2) declaring a player loss if said best possible dealer poker hand contains said higher ranking poker hand, and, (k3) declaring a push if neither said player hand nor said best possible dealer poker hand contains a higher ranking poker hand; and, (l) crediting to the player a predetermined amount, if a player win or if a push is declared.

20. A method of playing a card game according to claim 19, wherein the digital computer and the display device are connected together by a network.

21. A method of playing a card game according to claim 19, wherein the digital computer and the display device are incorporated into a video slot machine.

22. A method of playing a card game according to claim 19, wherein the digital computer and the display device are incorporated into a hand-held LCD game.

23. A method of playing a card game, wherein at least two conventional decks of fifty-two playing cards have been shuffled together to form a single game deck, comprising the steps of:

(a) at least one player initiating the card game;

(b) dealing five playing cards from said game deck, thereby forming a player hand, said five playing cards being dealt face-up;

(c) determining whether said player hand contains two or more cards of a same suit and rank, said two or more cards of a same suit and rank, if present, indicating a bust in said player hand;

(d) dealing seven playing cards from said game deck to form a dealer hand, said seven playing cards being dealt face-up;

(e) selecting five cards from said dealer hand to form a best possible dealer poker hand which does not contain two matching cards of a same suit and rank, if that is possible;

(f) determining whether said best possible dealer poker hand contains two or more matching cards of a same suit and rank, said two or more cards of a same suit and rank, if present, indicating a bust in said best possible dealer poker hand;

(g) determining a winner between said player hand and said best possible dealer poker hand according to the following rules, if said player hand contains a bust or said best possible dealer poker hand contains a bust, (g1) declaring a player hand loss if said player hand contains a bust, (g2) declaring a player hand win if said player hand does not contain a bust and said best possible dealer poker hand contains a bust, and, if neither said player hand nor said best possible dealer poker hand contains a bust, (g3) declaring a player hand win if said player hand contains a higher ranking poker hand than said best possible dealer poker hand, (g4) declaring a player hand loss if said best possible dealer poker hand contains a higher ranking poker hand than said player hand, and (g5) declaring a push if neither said player hand nor said best possible dealer poker hand contains a higher ranking poker hand.

24. A method of playing a card game on a gaming device whereon is exhibited at least a representation of a 5-card player hand and a representation of a 7-card dealer hand, said player hand and said dealer hand being randomly drawn from a game deck, said game deck consisting of at least two conventional 52-card decks of playing cards that have been shuffled together, and wherein a winner between said player hand and said dealer hand is determined according to the following method, comprising the steps of:

(a) determining whether said representation of a player hand contains two or more cards of a same suit and rank, said two or more cards of a same suit and rank, if present, indicating a bust in said player hand;

(b) selecting five cards from said representation of a dealer hand to form a best possible dealer poker hand which does not contain two matching cards of a same suit and rank, if that is possible;

(c) determining whether said best possible dealer poker hand contains two or more matching cards of a same suit and rank, said two or more cards of a same suit and rank, if present, indicating a bust in said best possible dealer poker hand;

(d) determining a winner between said player hand and said best possible dealer poker hand, according to the following rules, if said player hand contains a bust or said best possible dealer poker hand contains a bust, (d1) declaring a player hand loss if said player hand contains a bust, (d2) declaring a player hand win if said player hand does not contain a bust and said best possible dealer poker hand contains a bust, and, if neither said player hand nor said best possible dealer poker hand contains a bust, (d3) declaring a player hand win if said player hand contains a higher ranking poker hand than said best possible dealer poker hand, (d4) declaring a player hand loss if said best possible dealer poker hand contains a higher ranking poker hand than said player hand, and (d5) declaring a push if neither said player hand nor said best possible dealer poker hand contains a higher ranking poker hand.

25. A gaming device according to claim 24, wherein said gaming device is selected from the group consisting of a pull-tab, a video monitor, and a hand-held LCD game.

* * * * *